US007013535B2

(12) United States Patent
Tracy

(10) Patent No.: US 7,013,535 B2
(45) Date of Patent: Mar. 21, 2006

(54) WEB END

(75) Inventor: Richard J. Tracy, Elgin, IL (US)

(73) Assignee: Illinois Tool Works Inc., Glenview, IL (US)

( * ) Notice: Subject to any disclaimer, the term of this patent is extended or adjusted under 35 U.S.C. 154(b) by 50 days.

(21) Appl. No.: 10/715,151

(22) Filed: Nov. 17, 2003

(65) Prior Publication Data

US 2004/0134039 A1 Jul. 15, 2004

Related U.S. Application Data

(60) Provisional application No. 60/440,213, filed on Jan. 15, 2003.

(51) Int. Cl.
*F16L 11/00* (2006.01)

(52) U.S. Cl. ..... 24/265 R; 24/115 R; 24/115 H; 24/129 R

(58) Field of Classification Search ..... 24/34, 24/3.12, 3.13, 458, 484, 265 EE, 265 BC, 24/265 EC, 265 H, 265 AL, 3.4, 265 R, 24/115 R, 115 A, 115 H, 265 A, 129 R, 129 A; 40/1.5; 455/90, 351; 361/814
See application file for complete search history.

(56) References Cited

U.S. PATENT DOCUMENTS 967,664 A * 8/1910 Peterson ..... 24/265 H
4,038,726 A 8/1977 Takabayashi ..... 24/198
4,845,585 A * 7/1989 Weiss ..... 361/220
5,136,756 A * 8/1992 Krauss ..... 24/265 H
5,669,119 A * 9/1997 Seron ..... 24/265 H
5,671,508 A * 9/1997 Murai ..... 24/115 K
5,842,256 A 12/1998 Anscher ..... 24/3.4
5,878,467 A * 3/1999 Yokota ..... 24/265 EE
6,044,527 A * 4/2000 Ishida et al. ..... 24/129 R
6,453,519 B1 9/2002 Gelardi ..... 24/163 R
6,539,588 B1 * 4/2003 Brosofsky et al. ..... 24/3.4
6,618,910 B1 * 9/2003 Pontaoe ..... 24/115 H
6,711,785 B1 * 3/2004 Hicks et al. ..... 24/3.4
6,725,506 B1 * 4/2004 Anscher ..... 24/3.4

FOREIGN PATENT DOCUMENTS

JP 11-192110 7/1999

* cited by examiner

*Primary Examiner*—Jack W. Lavinder
(74) *Attorney, Agent, or Firm*—Mark W. Croll; Paul F. Donovan

(57) ABSTRACT

A one-piece clip or web end to join the cord ends of a lanyard is disclosed. The clip folds together and snap fits onto the cord ends to secure the ends together. The clip includes numerous pins extending outwardly from the clip body that mate with numerous pin pockets formed in the clip body to secure the cord ends together. The clip further includes mating locking tabs, and stabilizing ribs and recesses to facilitate the easy snap fit of the clip onto the cord ends of the lanyard without the use of special tools.

11 Claims, 6 Drawing Sheets

WEB END

CROSS REFERENCE TO RELATED APPLICATION

This Non-Provisional Application claims benefit to U.S. Provisional Application Ser. No. 60/440,213 filed Jan. 15, 2003.

FIELD OF THE INVENTION

The present invention relates generally to lanyards and more particularly to closures for lanyards that snap onto lanyard ends and are used to hold security or trade show identification badges or the like.

BACKGROUND OF THE INVENTION

It is known that lanyards are used to suspend identification or security badges, keys, cell phones, or other objects around a person's neck. Conventional lanyards include the use of a small cord or rope that is joined together at the cord ends to form a loop that fits over a person's head and around the neck. There are several known techniques to join the cord ends of the lanyard to form a loop. These techniques include tieing or gluing the cord ends together, or using multiple fastener components that must be attached onto the cord ends and then secured together. Typically, a ring or hook is connected to the formed loop to secure or suspend an object, such as an identification badge, around the person's neck.

These known lanyards and techniques for joining the lanyard cord ends, however, have certain drawbacks. For example, known lanyards use multiple components to join the lanyard cord ends resulting in greater complexity of the product, use of special tools, and increased difficulty in the use of the product. In addition, many of the known multiple components used to join lanyard cord ends are unreliable, have a high initial purchase cost, and an overall high cost application. The present invention is directed at overcoming these and other known problems and drawbacks with existing lanyards and specifically the problems associated with joining lanyard cord ends.

SUMMARY OF THE INVENTION

The present invention is directed to a lanyard that uses a single component to join the ends of the lanyard cord. The single component, referred to as a web end, folds together over the lanyard cord ends and snap fits onto the ends to secure the cord ends together. To secure the cord ends together, the web end uses numerous pins extending out from the web end that will engage with numerous pin pockets after the web end is folded together. The lanyard cord ends are trapped between the numerous pins and pin pockets. A ring, hook or other attachment member may be connected to the web end to attach an identification badge or other object to the lanyard. With the present invention, the web end is easily attached by hand to the lanyard cord ends without the use of special tools.

Other features and advantages of the invention will become apparent to those skilled in the art upon review of the following detailed description, claims and drawings in which like numerals are used to designate like features.

Figure 1:
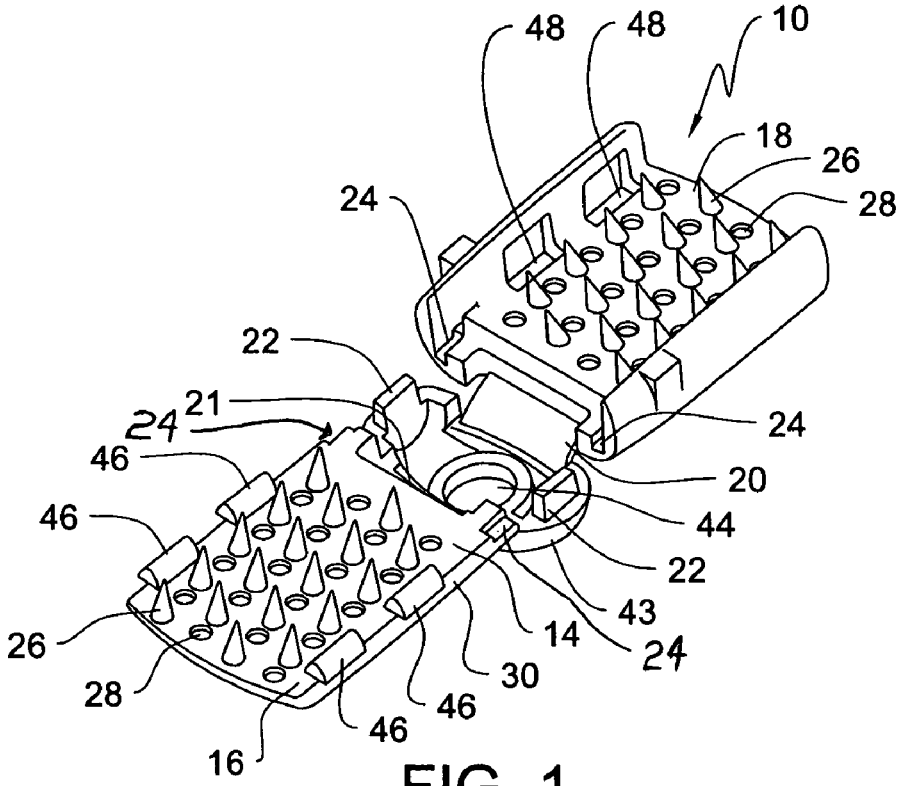
FIG. 1 is an isometric view of an exemplary web end of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

Figure 2:
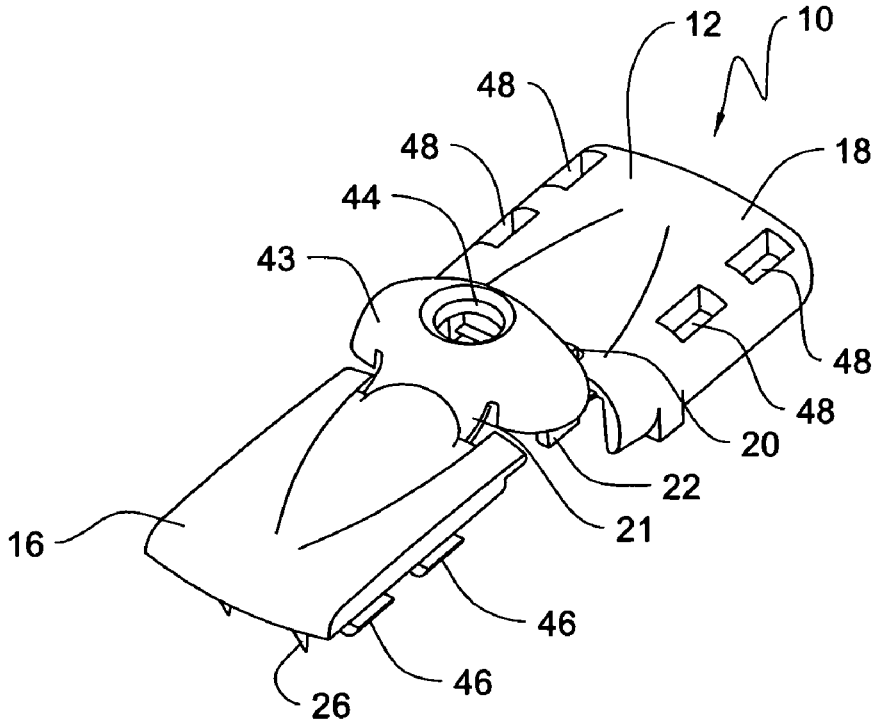
FIG. 2 is another isometric view of the invention of FIG. 1.

Referring to FIGS. 1 and 2, an exemplary embodiment of the invention is depicted as a one-piece web end 10. The web end 10, also referred to as a clip, is used to secure together the opposing ends of a lanyard cord. Once secured together, the lanyard forms a loop that may be placed over a person's head and around the neck. The web end 10 may also receive an attachment member, discussed below, that can be used to mount or connect an identification badge, tag or other object to the lanyard.

Figure 5:
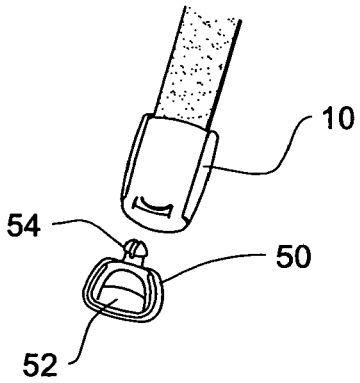
FIG. 5 is an isometric exploded view of an attachment that may be mounted onto the invention of FIG. 1.
Figure 6:
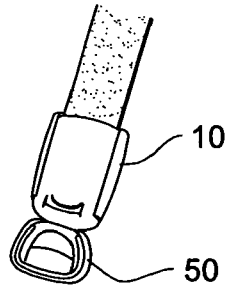
FIG. 6 is an isometric view of the assembly of the attachment of FIG. 5 to the invention of FIG. 1.

As illustrated in FIGS. 1 and 2, the web end or clip 10 is depicted in an open, unattached and unsnapped position. In this position, the web end 10 defines an outer surface wall 12, an inner surface wall 14, and opposing ends 16, 18. Located between and connecting the opposing ends 16, 18 of the web end 10 are hinges 20, 21 that permit the opposing ends 16, 18 to fold together. It should be understood that the invention may use fewer hinges to permit the folding together of the ends 16, 18. Located between the hinges 20, 21 is a central portion 43 defining a central aperture 44 that is used to connect an attachment 50 to the web end 10, as shown in FIGS. 5 and 6 and discussed in more detail below. Also depicted in FIG. 1, the web end 10 includes integral stabilizing ribs 22 that extend outwardly from the inner surface of the central portion 43. In use, the stabilizing ribs 22 engage stabilizing rib recesses 24 formed in the body of the web end 10 to align the opposing ends 16, 18 of the web end 10 when the web end 10 is folded together and attached to the cord ends of the lanyard. In an exemplary embodiment, the stabilizing ribs 22 and rib recesses 24 are positioned near the peripheral edge 30 of the web end 10 and adjacent or in close proximity to the hinges 20, 21. The web end 10 is preferably made from a plastic material, polymer, or similar suitable material.

Also shown in FIG. 1, the web end 10 includes on the inner surface wall 14 a plurality of conical shaped interlocking pins 26 that are spaced apart in an array. Also spaced apart in an array is a plurality of pin pockets or pin receptacles 28. The pins 26 and pin pockets 28 are located on both ends 16, 18 of the web end 10 and are positioned on the web end 10 such that when the web end 10 is folded at the hinges 20, 21, and over the cord ends, the pins 26 and pin pockets 28 mate with each other, as illustrated in the embodiment shown in FIGS. 3 and 4. In use, the mated plurality of pins 26 and pin pockets 28 will trap and secure the cord ends 40, 42 to the web end 10 and will prevent movement of the cord ends 40, 42 relative to the web end 10 under an applied tension, as shown in FIG. 4. In other words, when the ends 16, 18 of the web end 10 are folded onto the cord ends 40, 42, the interlocking pins 26 on one end of the web end 10 will pierce through the cord ends 40, 42 and extend into and mate with the pin pockets 28 on the opposing end of the web end 10 to securely hold the web end 10 onto the cord ends 40, 42. With the invention, the cord ends 40, 42 are prevented from being pulled out of the web end 10 under an applied tension.

Referring to FIG. 4, each of the pins 26 define a pin tip 32 that extends into the pin pocket 28 and is held in place in the mating pin pocket 28. As the cord ends 40, 42 are pulled or placed under an applied tension, the pin 26 will have a tendency to bend about its base 34 until the tip 32 of the pin 26 contacts that inner wall 36 of the pin pocket 28 at which point the pin 26 is prevented from bending any further. With this construction, the premature pull-out of the cord ends 40, 42 is greatly improved. It should be understood that while the disclosed plurality of pins 26 have a conical shape and extend outwardly from the inner surface wall 14 of the web end 10, the pins 26 may take on other various shapes, such as pyramids, columns, squares or similar shapes, and still achieve the desired securement of the cord ends 40, 42 to the web end 10. It should also be understood that other arrays, configurations, and numbers of pins 26 and pin pockets 28 are possible and may be used with the present invention.

Referring back to FIGS. 1 and 2, the web end 10 includes the central aperture 44 located between the hinges 20, 21 for mounting the web end 10 to an attachment member 50, as discussed below. The central aperture 44 may take on numerous shapes, such as round, square, geometrical, or non-geometrical configurations, or other similar shapes and configurations, to receive various types of attachment members, as known in the art. The web end 10 further may include a plurality of locking tabs 46 extending outwardly from the inner surface wall 14. In the exemplary embodiment, the locking tabs 46 are located around the peripheral edge 30 of the web end 10. It should be understood that the invention is not limited to the illustrated location of the locking tabs 46 as one or more of these tabs could be located at a position on the web end 10 not at the peripheral edge 30. These locking tabs 46 are received within a plurality of openings 48 also located in the exemplary embodiment around the peripheral edge 30 of the web end 10 when the web end 10 is folded at the hinges 20, 21. These plurality of locking tabs 46 and openings 48 permit the opposing ends 16, 18 of the web end 10 to interlock and snap together.

Figure 3:
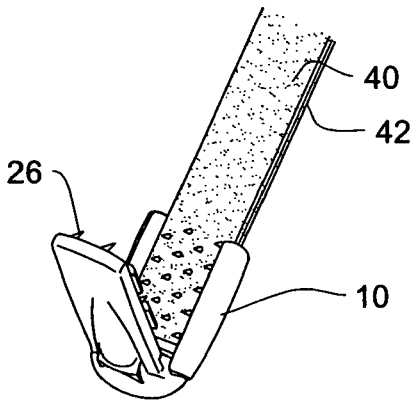
FIG. 3 is an isometric view of the installation of the invention of FIG. 1 onto the cord ends of a lanyard.
Figure 4:
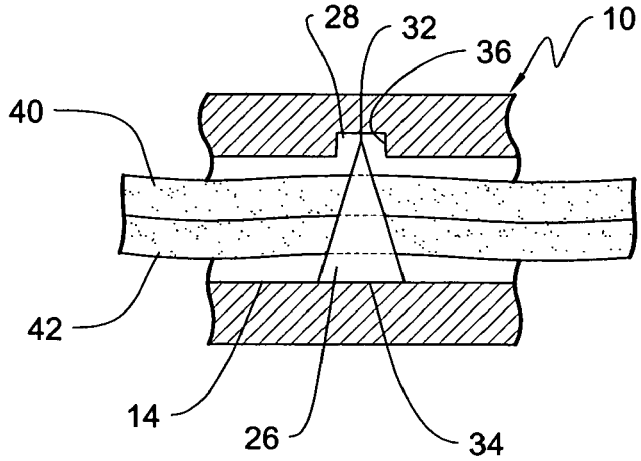
FIG. 4 is a cross-section view of the invention of FIG. 1 installed onto the cord ends of a lanyard.

As illustrated by FIG. 3, the interlocking of the opposing ends 16, 18 of the web end 10 onto the cord ends 40, 42 is easily accomplished by hand without the use of special tools. As exemplified and explained above, the cord ends 40, 42 are inserted between the opposing ends 16, 18 of the web end 10. The web end 10 is folded at the hinges 20, 21 with the stabilizing ribs 22 aligning with the stabilizing recesses 24. The pins 26 and pin pockets 28 on the inner surface wall 14 of the web end 10 secure the cord ends 40, 42 in position by trapping the cord ends between engaging pins 26 and pin pockets 28. The plurality of locking tabs 46 and openings 48 positioned along the peripheral edge 30 of the web end 10 interlock with each other and by merely applying hand pressure to the opposing ends 16, 18, cause the opposing ends 16, 18 to snap together, thereby securing and trapping the cord ends 16, 18 within the web end 10. As should be readily apparent, the web end 10 of the present invention is more readily installed than other known devices because of this ergonomically advantageous assembly. It should also be readily apparent to one of skill in the art that other shapes, designs, and features of the web ends are possible with the present invention.

Referring to FIGS. 5 and 6, there is depicted an attachment member 50 that may be installed onto the web end 10. Specifically, in an exemplary embodiment, the attachment member 50 includes a loop 52 and a projection 54 extending outwardly from the loop 52. The projection 54 is sized and shaped to snap fit into the central aperture 44 of the web end 10 to secure the attachment member 50 onto the web end 10. An identification badge or other object may be attached to the loop 52 of attachment member 50. It should be understood that other shapes, designs and styles of attachment member 50 and loop 52, such as uniform, geometric, non-uniform or non-geometric shapes, designs and styles may be used with the present invention.

Figure 7:
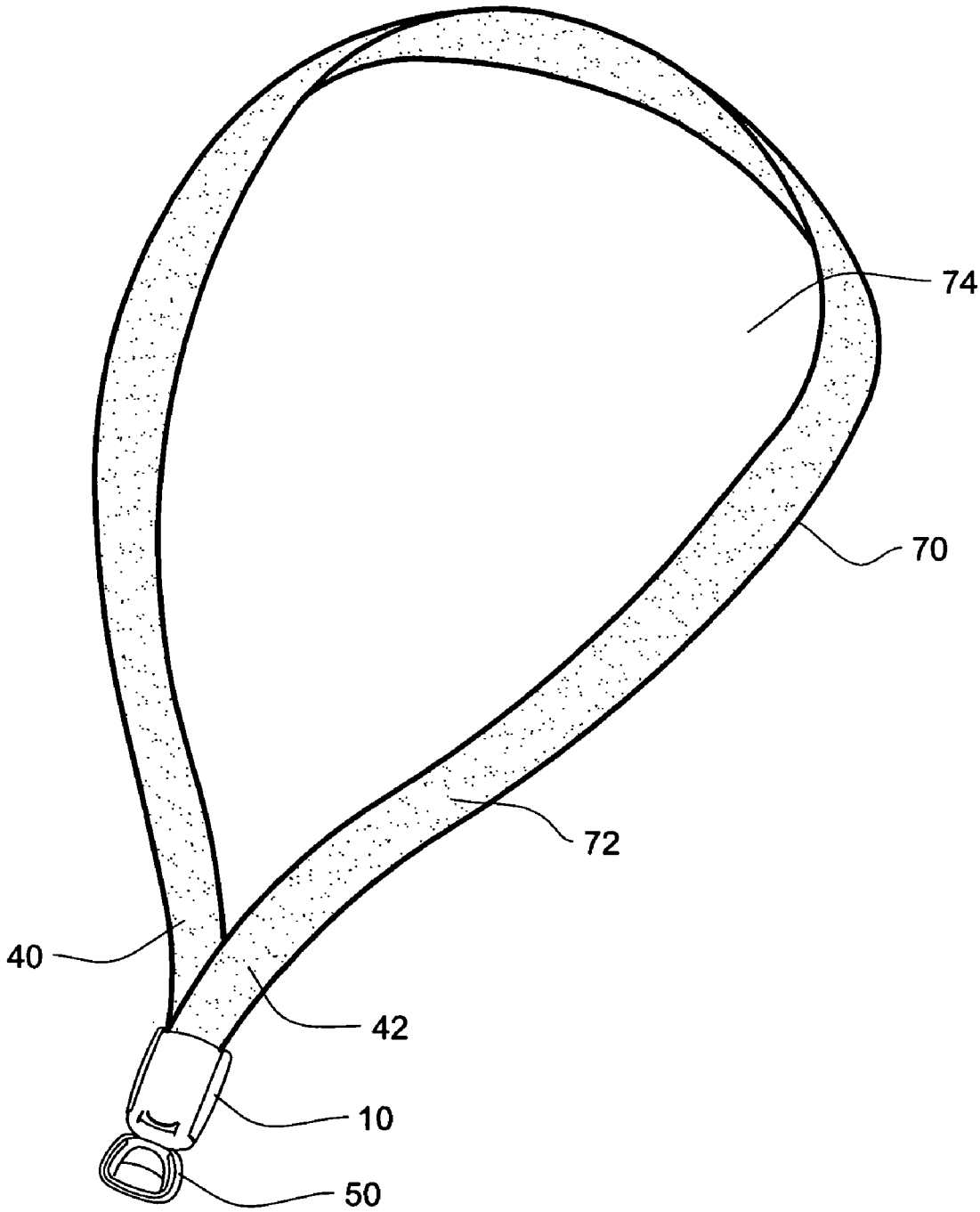
FIG. 7 is an isometric view of the assembly of the invention of FIG. 1 and the attachment of FIG. 5 with a lanyard.
Figure 8:
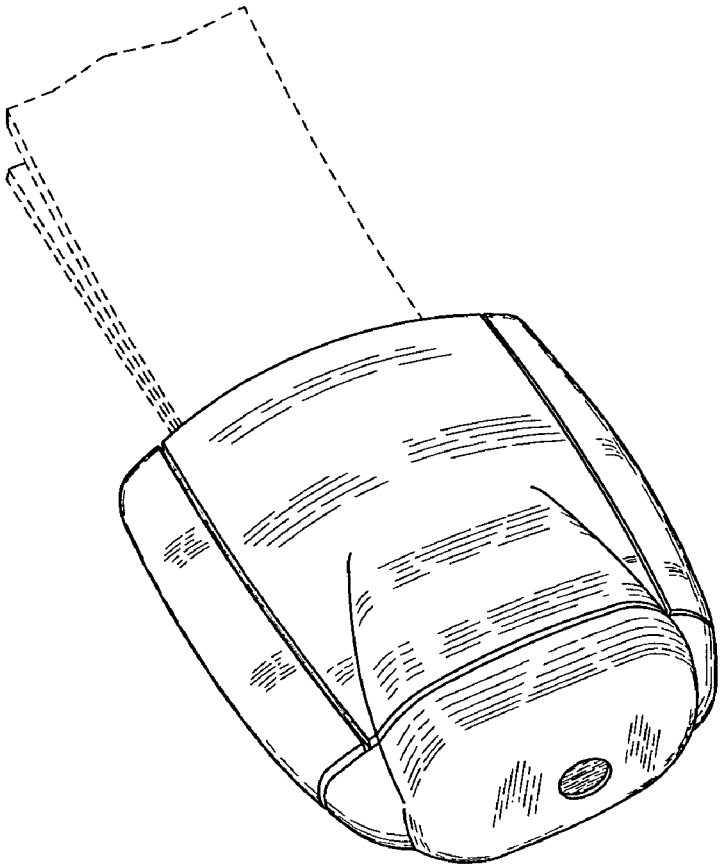
FIGS. 8–11 illustrate various views of an alternative web end according to the present invention.
Figure 9:
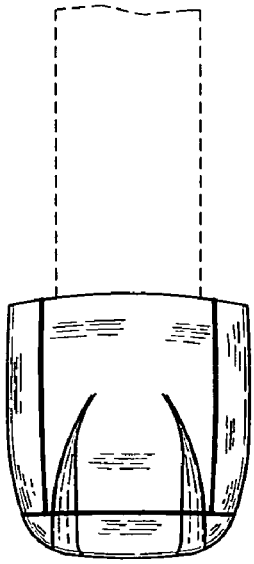
Figure 10:
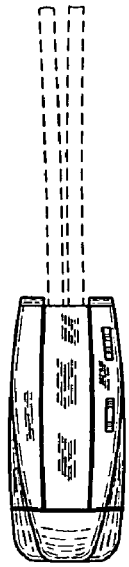
Figure 11:
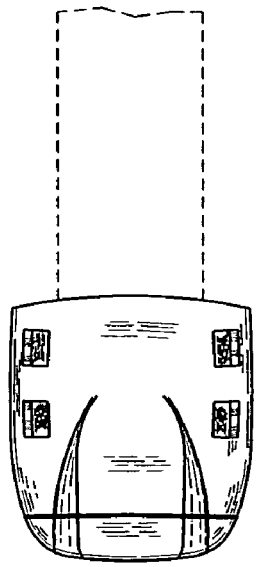
Figure 12:
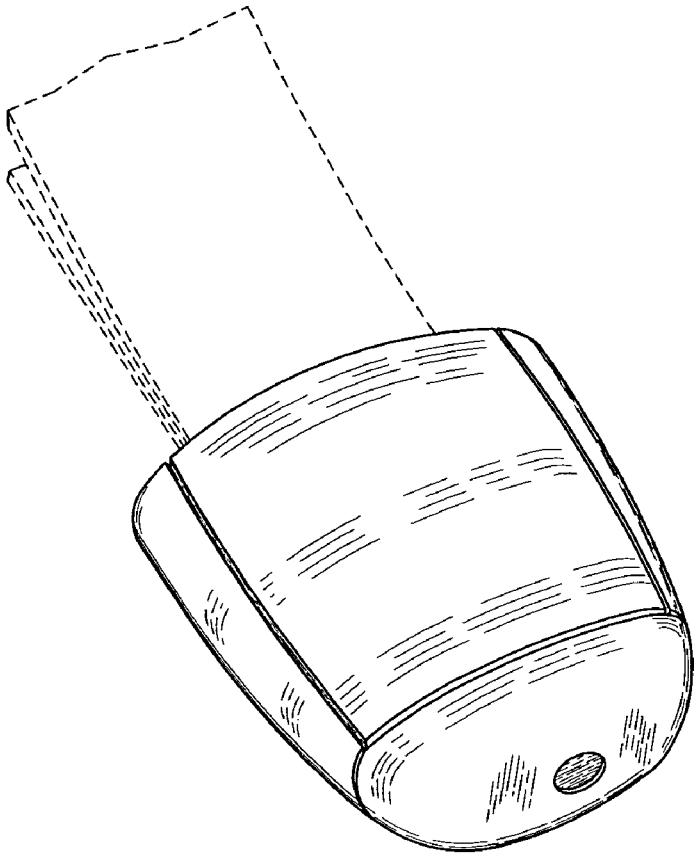
FIGS. 12–15 illustrate various views of yet another alternative web end according to the present invention.
Figure 13:
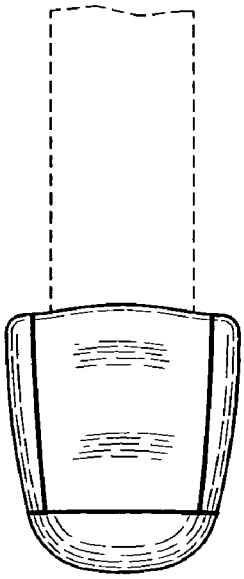
Figure 14:
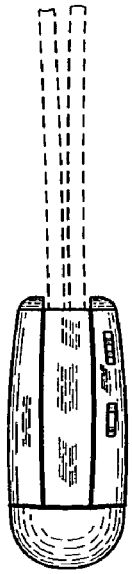
Figure 15:
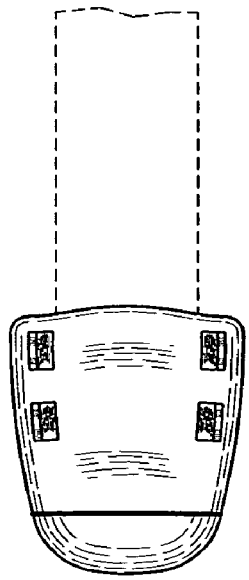
Figure 16:
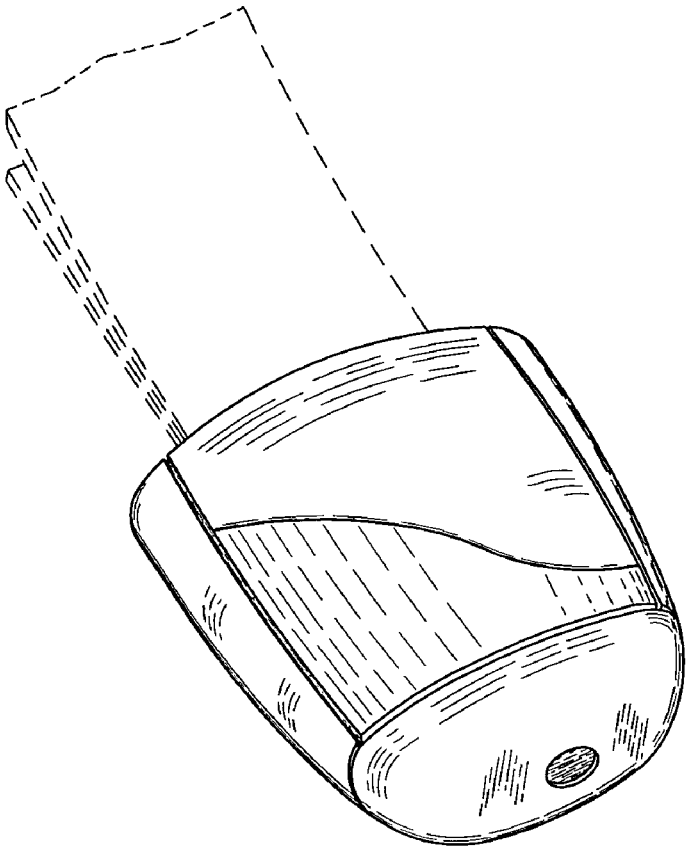
FIGS. 16–19 illustrate various views of still another alternative web end according to the present invention.
Figure 17:
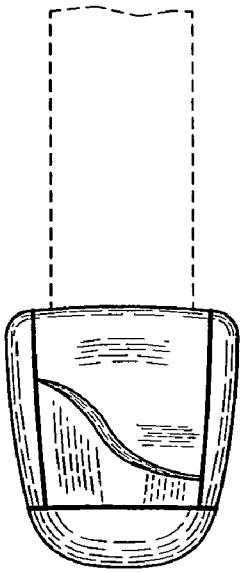
Figure 18:
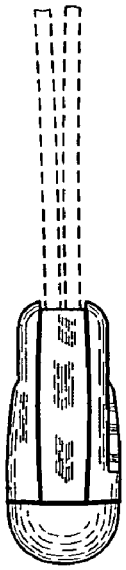
Figure 19:
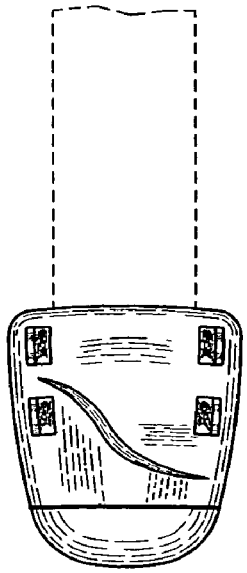

Referring to FIG. 7, there is depicted a lanyard 70 typically used to secure or suspend from a person's neck a small object, such as an identification badge or tag. The lanyard 70 includes a cord, which may be a webbing material 72 that forms a large loop 74 that, in use, is placed over a person's head and around the neck. The lanyard 70 defines cord ends 40, 42. Mounted to the cord ends 40, 42 of the lanyard 70 is the web end 10 of the present invention. As discussed above, the web end 10 snap fits onto the cord ends 40, 42 and secures the cord ends together. Also, as discussed above, mounted to the web end 10 is the attachment member 50 that is used to connect or mount an identification badge or other object, not shown, to the lanyard 70.

FIGS. 8–19 illustrate various views of alternative designs according to the present invention.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A lanyard comprising:

a lanyard cord, the lanyard cord having a first end and a second end;

a web end removably attached to the first and second ends of the lanyard cord, the web end defining opposing ends joined together by a central portion and a pair of hinges, one on each side of the ceniral portion, the central portion including a aperture and a pair of stabilizing ribs, one on each side of the aperture, each of the opposing ends having stabilizing rib recess configured to align with the stabilizing ribs when the web end is folded at the hinges, a inner wall, surface with a plurality of pin pockets extending inwardly thereof, and a plurality of pins extending outwardly therefrom, each pin having a pin tip, wherein the plurality of pin tips of one end of the opposing ends operatively mate with the plurality of pin pockets of the other end of the opposing ends when the opposing ends are brought together to trap and secure the first ad second ends of the lanyard cord therebetween; and an attachment member removably mounted to the central portion of the web end, the aperture of the central portion being adapted to receive the attachment member, the attachment member defining a loop for mounting an object to the lanyard.

2. The lanyard as set forth in claim 1, wherein the web end further includes a plurality of locking tabs and recesses to permit the opposing ends to snap fit together.

3. The lanyard as set forth in claim 2, wherein the first and second ends of the lanyard cord are placed between the plurality of pins and pin pockets.

4. The lanyard as set forth in claim 1, wherein each of the plurality of pins define spin tip, each of the pins extending through the first and second ends of the lanyard cord and each of the pin tips operatively engaging the pin pockets to secure the first and second ends onto the web end.

5. Alanyard comprising:

a cord, the cord having a first end and a second end;

a one-piece clip for joining the first and second ends of the cord together, the clip defining opposing ends joined together by a central portion, a first hinge and a second hinge, the first hinge being located on one side of the central portion and the second hinge being located on an opposite side of the central portion, the central portion including an aperture, a first stabilizing rib and a second stabilizing rib, the first stabilizing rib being located on one side of the aperture and the second stabilizing rib being located on an opposite side of the aperture, at least one of the opposing ends of the clip having stabilizing rib recesses configured to align with the first and second stabilizing ribs when the clip is folded at the hinges, each of the opposing ends of the clip, having an inner wall, surface with a plurality of pin pockets extending inwardly thereof, and a plurality of pins extending outwardly therefrom, wherein the plurality of pockets are positioned adjacent to the plurality of pins, the plurality of pins and pin pockets securing together the first and second ends of the cord, wherein each of the plurality of pins define a pin tip, each of the pin tips extending through the first and second ends of the cord and each of the pin tips operatively mating with the pin pockets to secure the first and second ends onto the clip; and an attachment member removably mounted to the clip for mounting an object to the lanyard, the aperture of the central portion configured to receive the attachment member.

6. The lanyard as set forth in claim 5, wherein the clip further includes a plurality of locking tabs and recesses to permit the opposing ends to snap kit together.

7. The lanyard as set forth in claim 5, wherein the first and second ends of the cord are placed between the plurality of pins and pin pockets.

8. The lanyard as set forth in claim 5, wherein the attachment member defines a loop and a projection, the projection operatively engaging the aperture in the central portion.

9. A clip for use with a lanyard comprising:

a foldable, one-piece clip body, the clip body defining an inner surface, an outer surface, and opposing ends, the opposing ends joined together by a central portion and a pair of hinges, one on each side of the central portion, the central portion including an aperture and a pair of stabilizing ribs, one on each side of the aperture, each of the opposing ends on the inner surface having stabilizing rib recesses configured to align with the stabilizing ribs when the clip is folded at the hinges, a plurality of pin pockets extending inwardly thereof and being positioned in close proximity to a plurality of pins extending outwardly from the inner surface, each pin having a pin tip, wherein, the plurality of pin tips on one end of the opposing ends operatively mate with the plurality of pin pockets on the ether end of the opposing ends when the opposing ends are brought together to trap and secure first and second ends of a cord placed therebetween, the opposing ends further including a plurality of locking tabs and recesses for snap fitting together the opposing ends of the foldable clip body when the opposing ends are brought together, such that as one or both of the first and second ends of the cord are pulled or placed under an applied tension, each pin will have a tendency to bend about its respective base until the pin is prevented from bending any further on account of operative interaction with an inner wall of the associated pocket, thereby preventing the ends of the cord from being pulled out of the web under an applied tension, the aperture of the central portion being adapted to receive an attachment for attaching an object to the lanyard.

10. The clip as set forth in claim 9, wherein the central portion defines an opening through the clip body.

11. The clip as set forth in claim 9, wherein the plurality of pins are conical shaped.

* * * * *